US005237944A

United States Patent [19]

Willenbacher et al.

[11] Patent Number: 5,237,944

[45] Date of Patent: Aug. 24, 1993

[54] STITCH-FORMING MACHINE WITH A TRANSDUCER AND A CONTROL DEVICE

[75] Inventors: Erich Willenbacher, Karlsruhe; Bernhard Mertel, Enkenbach-Alsenborn; Rainer Spickermann, Thaleischweiler; Walter Sinn, Medard, all of Fed. Rep. of Germany

[73] Assignee: G. M. Pfaff Aktiengesellschaft, Kaiserslautern, Fed. Rep. of Germany

[21] Appl. No.: 688,482

[22] PCT Filed: Nov. 17, 1989

[86] PCT No.: PCT/EP89/01383

§ 371 Date: Jun. 25, 1991

§ 102(e) Date: Jun. 25, 1991

[87] PCT Pub. No.: WO90/05804

PCT Pub. Date: May 31, 1990

[30] Foreign Application Priority Data

Nov. 24, 1988 [DE] Fed. Rep. of Germany ..... 3839733

[51] Int. Cl.[5] ..... D05B 69/36

[52] U.S. Cl. ..... 112/273; 112/278

[58] Field of Search ..... 112/273, 278, 275, 277; 242/37 R

[56] References Cited

U.S. PATENT DOCUMENTS

| | | | |
|---|---|---|---|
| 4,628,847 | 12/1986 | Rydborn | 112/273 |
| 4,763,588 | 8/1988 | Rydborn | 112/273 |
| 4,793,273 | 12/1988 | Hara et al. | 112/278 X |
| 4,938,159 | 7/1990 | Shibata | 112/273 |

*Primary Examiner*—Peter Nerbun

*Attorney, Agent, or Firm*—McGlew and Tuttle

[57] ABSTRACT

A stitch forming machine is provided including a transducer for determining the tension present in a thread, wherein the thread tension assumes a higher value during stitch formation and the transducer provides a signal representing the tension level. The control is provided for evaluating the signal corresponding to the tension level. The control includes a comparator device for comparing a peak of the signal representing the tension level, which peak can be used to detect a malfunction, with a limit signal, corresponding to a limit tension. The comparator sends a signal to a switching device when a signal peak drops below the limit signal. The switching device may be connected to a shut-off device of the drive motor of the machine as well as one or more display elements. In this way, the machine may be stopped and the display element associated with a limit tension, below which the tension dropped by a switching device. The comparator may, according to another aspect of the invention, only provide a signal for energizing a switch depending upon a stitch formation phase associated with a signal peak which drops below a limit signal.

14 Claims, 5 Drawing Sheets

Fig. 2
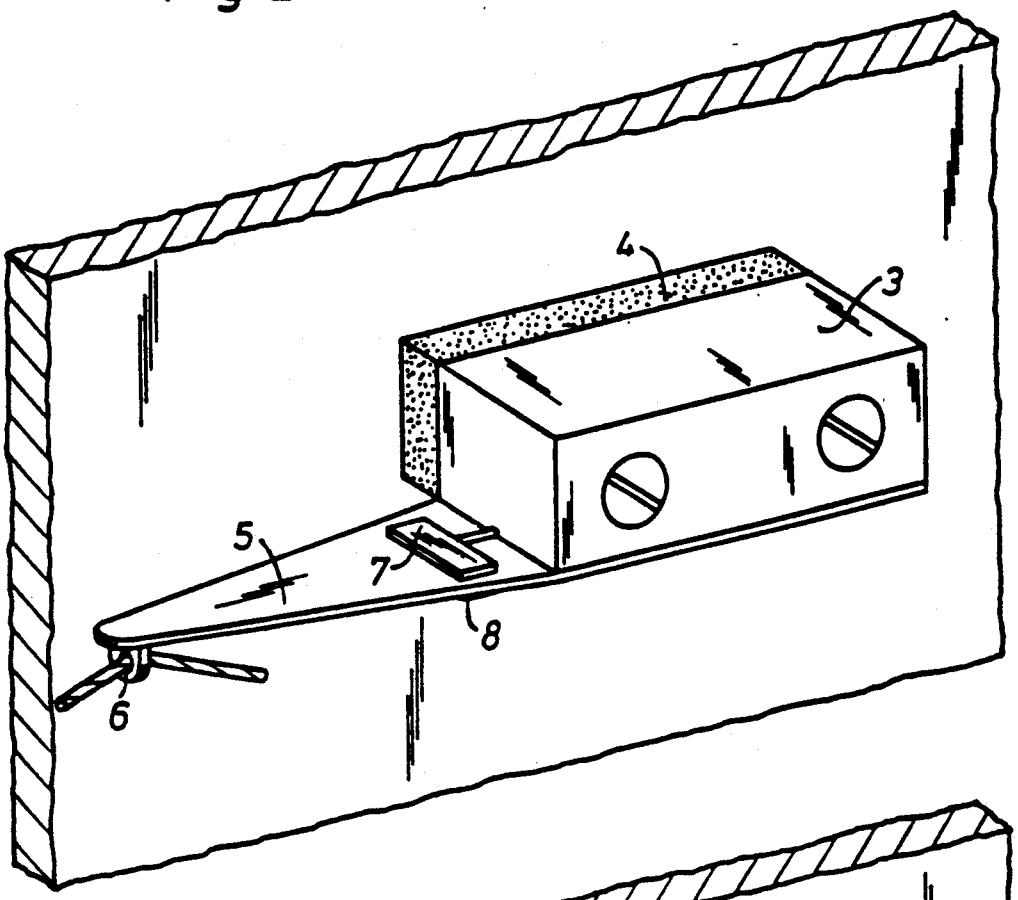
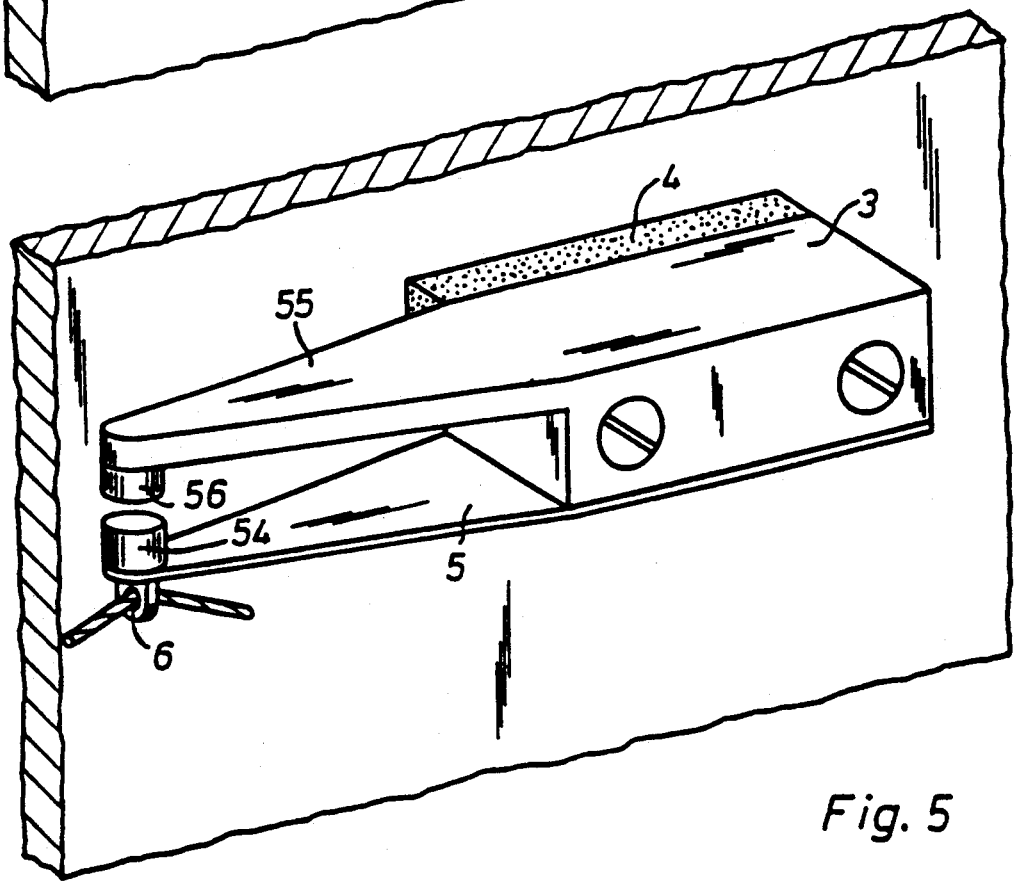
Fig. 5

STITCH-FORMING MACHINE WITH A TRANSDUCER AND A CONTROL DEVICE

FIELD OF THE INVENTION

The present invention pertains generally to stitch-forming machines and more particularly to a thread monitor for indicating missed stitches.

BACKGROUND OF THE INVENTION

A thread monitor, known from U.S. Pat. No. 4,170,951, is arranged on a sewing machine in the path of the needle thread and is provided with a transducer with a spring clip, to which a wire strain gauge element, hereinafter called a WSG element, is fastened. The WSG element produces an electrical voltage that is proportional to its mechanical deformation caused by the deflecting movement of the spring clip. The electrical voltage is fed into an evaluating electronic unit following the transducer.

In the course of a stitch, a first, lower tension level is produced during the expansion of the needle thread loop, and a second, higher tension level is generated during the knotting. To detect missed stitches, the tension levels are monitored in measuring windows, whose positioning and size are predetermined by two signal generators that monitor the position of the arm shaft.

A plurality of actual values are determined from the lower tension level, and compared with a threshold value, whose value depends on the maximum of the higher tension level generated during the preceding stitch. If all actual values are below this threshold value, a warning signal is sent by the evaluating electronic unit to indicate a missed stitch.

Since the maximum of the higher tension level may differ from the corresponding value of the preceding stitch during each stitch, and the threshold value depends on this maximum, the threshold value is to be determined anew for each stitch. Such a signal evaluation is problematic especially at high sewing speeds and requires the use of an expensive evaluating electronic unit.

Due to its dependence on the preceding higher tension level, the threshold value cannot be formed during the first stitch performed with ordinary tension after start-up of the sewing machine, which causes a delay in the monitoring process. To prevent this disadvantage, additional control elements not disclosed in U.S. Pat. No. 4,170,951 are necessary. This increases the circuit complexity of the evaluating electronic unit, which is suitable exclusively for indicating missed stitches caused by lack of expansion of the needle thread loop.

SUMMARY AND OBJECTS OF THE INVENTION

It is a primary object of the present invention to design a control device of a stitch-forming machine equipped with a transducer, so that the control device is able to evaluate the measured values sent by the transducer, at low circuit complexity, beginning from the first stitch performed with ordinary tension to detect a majority of different missed stitches as well as thread disturbances on the thread being monitored and on the threads to be connected to this by stitch formation.

According to the invention, a stitch forming machine is provided including a transducer for determining the tension present in a thread, wherein the thread tension assumes a higher value during stitch formation and the transducer provides a signal representing the tension level. Control means are provided for evaluating the signal corresponding to the tension level. The control means includes a comparator device for comparing a peak of the signal representing the tension level, which peak can be used to detect a malfunction, with a limit signal, corresponding to a limit tension. The comparator sends a signal to a switching device when a signal peak drops below the limit signal. The switching device may be connected to a shut-off device of the drive motor of the machine as well as one or more display elements. In this way, the machine may be stopped and the display element associated with a limit tension, below which the tension dropped by a switching device.

According to another aspect of the invention, a stitch forming a machine is provided included a transducer for determining the tension in a thread and for outputting a signal representing the tension of the thread. Control means are provided for evaluating the signal representing the tension of the thread, the tension of the thread assuming higher values while stitches are formed. Control means are provided for evaluating the thread tension based on the stitch formation stage. The control means includes a comparator device for comparing a peak in the transducer signal corresponding to a peak in the tension level, the peak being used to detect a malfunction, with a predeterminable, common limit signal representing a common limit tension. The comparator provides a signal for energizing a switch depending upon a stitch formation phase associated with a signal peak which drops below a limit signal. The switching device is connected to a shut-off device of a drive motor of the machine or a plurality of display elements so that the machine can be stopped and the display element associated with the phase of stitch formation can be switched by the switching device.

The control device according to the present invention makes it possible to detect a plurality of different malfunctions on the thread, such as different types of missed stitches or the break of the needle thread and—in the case of double lockstitch machines as well as multi-thread chain stitch machines—the break of the hook or looper thread by means of a single transducer, because such a malfunction is positively demonstrable by the change in the value of the tension peak associated with this.

Monitoring the tension peaks by a comparator device, according to the invention, is advantageous if at least one of the tension levels has a plurality of tension peaks. Since not every of these voltages peaks is usually suitable for detecting a malfunction, only those peaks from which a malfunction is recognizable are monitored. This makes it possible to reduce the monitoring time to a minimum.

Since a plurality of different malfunctions can be recognized by monitoring the tension peaks, it is advantageous to stop the machine in the case of a malfunction and to indicate the malfunction by a separate display element associated with this. The display element, which can be switched via the switching device, may be designed as an optical or acoustic warning device.

By presetting the limit tension associated with the actual tension peak according to one aspect of the invention or the limit tension that is uniform for all tension peaks according to another aspect of the invention, it is ensured that the tension peaks can be monitored even during the first stitch performed with ordinary tension, because the corresponding limit voltage can immediately be associated with each tension peak by the comparator device.

By presetting a limit tension adjusted to the respective tension peak by the comparator device, the tension value below which a malfunction is recognizable can be individually adjusted to the maximum of the tension peak, so that a malfunction can be indicated as quickly as possible after it appears, but variations in the values of the voltage peaks that are caused by the sewing technique bring about no switching process.

In the design of the comparator device according to another aspect of the invention, a common limit tension is set for all tension peaks regardless of their values in order to simplify the circuit. The phase of stitch formation of the machine, which is sent as a signal to the comparator device, is needed as a second unit of information. The reduction of the voltage peak below the limit tension is used to detect a malfunction here, while the nature of the malfunction can be determined from the phase of stitch formation associated with the tension peak.

A particularly advantageous application of the control device according to the present invention is disclosed in which different missed stitches caused by a pick-up or stitch-down error, as well as a break or end of the needle thread and hook or looper thread can be recognized by monitoring the tension peaks that indicate the corresponding information.

Measurement experiments have shown that such parameters as the speed of sewing, stitch length, and the thread properties cause only insignificant changes in the maximum of the voltage peaks, whereas the setting of the tensioning device substantially affects it. To rule out disadvantages during thread monitoring in the case of a changed setting of the tensioning device, the limit tension and consequently also the response threshold of the comparator device are adjusted to the thread voltage set by the adjusting device.

Due to the measure of providing a spring member that can be deflected by the tensioned thread with a sensor device responsive to the proportioned deflection wherein the spring element tapers towards its free end beginning from its point of clamping, the spring element has the lowest possible weight at a predetermined bending strength. As a result, the effect of the natural oscillations of the spring element on the values of the thread tension sent to the control device will be negligible even at high sewing speeds.

The measure of fastening the transducer on the machine via a damping element, reduces the oscillations transmitted from the machine to the transducer to a negligible level, so that the values of the thread tension are not distorted by these oscillations.

The measure of providing the transducer arranged immediately downstream of a tensioning device, with respect to a direction of pull, leads to the variations in tension brought about by stitch formation being reduced to a minimum, which might cause distortion of the thread tension transmitted to the control device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 2 is a partially sectional view showing the transducer according to FIG. 1 on a larger scale;

FIG. 4*a:* thread voltage ($U_F$) without malfunction,

FIG. 4*b:* thread voltage ($U_F$) during a pick-up error or disturbance on the needle thread, FIG. 4*c:* thread voltage ($U_F$) during a stitch-down error or a disturbance on the hook or looper thread, FIG. 4*d:* comparator voltage ($U_K$) without malfunction, FIG. 4*e:* comparator voltage ($U_K$) during a malfunction according to FIG. 4*b,*

FIG. 4*f:* comparator voltage ($U_K$) during a malfunction according to FIG. 4*c,*

FIG. 4*g:* impulses (I) of a position transmitter;

FIG. 5 is a partially sectional view showing a second embodiment of the transducer on a larger scale;

DETAILED DESCRIPTION OF THE PREFERRED EMBODIMENT

Figure 1:
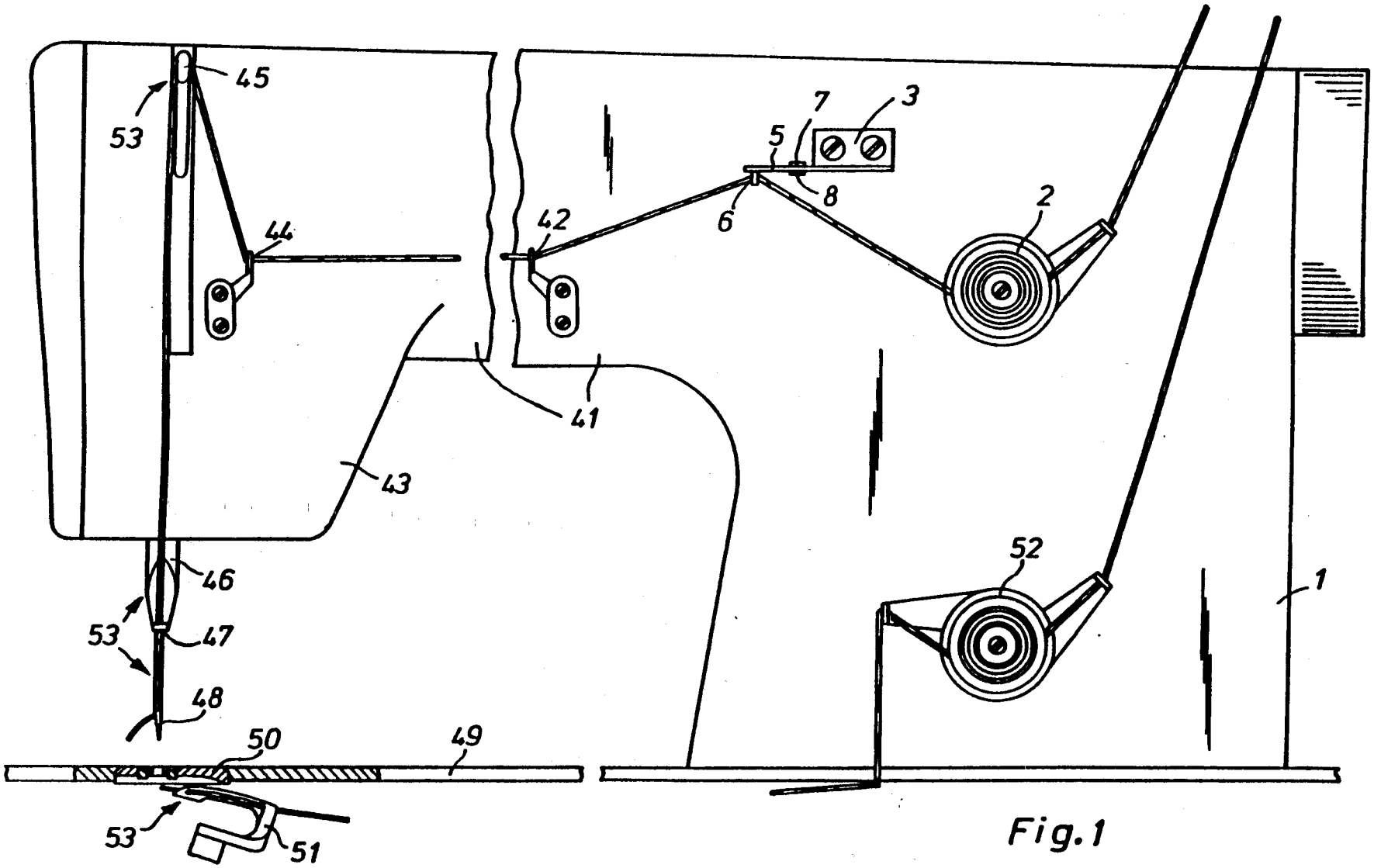
FIG. 1 in a side partially sectional view of a sewing machine with a thread monitor equipped with a transducer according to the invention.

A tensioning device 2 for the needle thread coming from a thread reserve (not shown) is arranged on the stand 1 of the double-thread chainstitch sewing machine shown in FIG. 1. A transducer 3, which is fastened to the sewing machine via a damping element 4 (FIG. 2) made of, e.g., rubber, is provided behind the tensioning device 2 in the direction of thread pull. The transducer 3 has a bending bar 5, whose width is reduced toward the free end beginning from the clamping point. At its free end, the bending bar 5 is designed on the underside with a needle thread-receiving eye 6 on it.

Wire strain gauge elements, hereinafter called WSG elements 7, are provided to receive the tension of the needle thread. A first WSG element 7 is fastened on the top side and a second WSG element 8 on the underside of the bending bar 5 close to the point of clamping of the bending bar.

Figure 3:
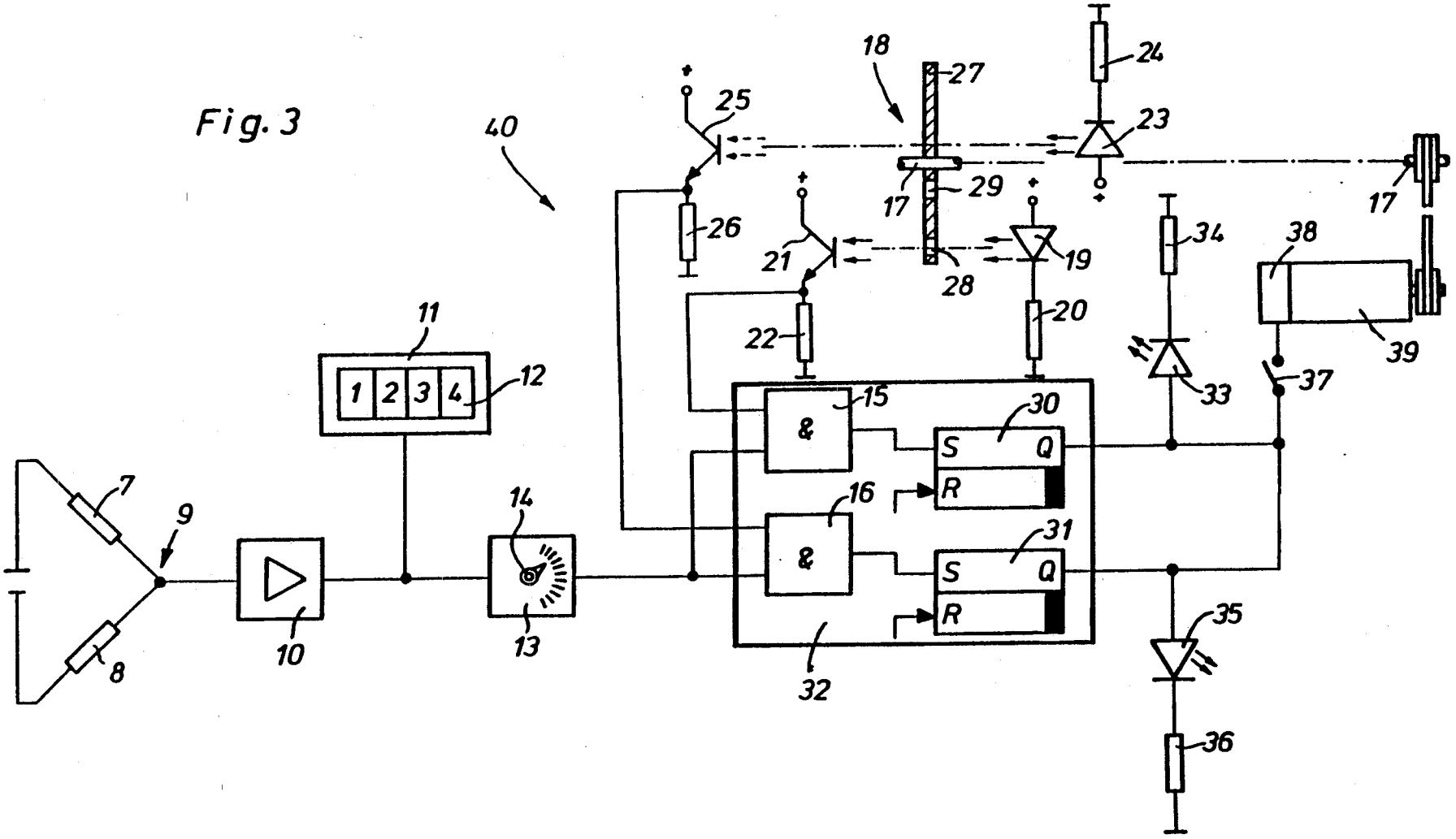
FIG. 3 is a circuit diagram showing a simplified control device according to the invention.

The WSG elements 7 and 8 are connected to a power source (FIG. 3) and are connected to form a half bridge 9 which is connected to an amplifier 10. The output of the amplifier 10 is connected to a voltmeter 11 with a display unit 12 and to a comparator 13 with an adjusting device 14 serving to set its switching threshold.

The output of the comparator 13 is connected to one input of AND elements 15 and 16 each, whose second input is connected to a position transmitter 18 that counts the revolutions of the main shaft 17. This position transmitter 18 has a photodiode 19, which is connected to the positive pole of a stabilized power source, is grounded via a resistor 20, and has a photodetector 21, which is designed as a phototransistor, is also connected to the positive pole, and is grounded via a resistor 22. The position transmitter 18 is also provided with a photodiode 23, which is connected to the positive pole of the power source, is grounded via a resistor 24, as well as with a photodetector 25, which is also connected to the positive pole, is designed as a phototransistor, and is grounded via a resistor 26. A disk 27, which is arranged nonrotatably on the main shaft 17, is provided between the photodiodes 19 and 23 and the photodetector 21 and 25; the disk 27 has—in the light path between the photodiode 19 and the photodetector 21—a first opening 28 and, on another radius, in the light path between the photodiode 23 and the photodetector 25, a second opening 29 for passage of the light beams. During each passage through the opening 28, an impulse is sent to the AND element 15, and during each passage through the opening 29, an impulse is sent to the AND element 16, and the AND element 16 is energized for a period corresponding to rotation of the disk 27 through 180° after the AND element 15.

The output of the AND element 15 is connected to the setting input S of a flip-flop memory 30, and that of the AND element 16 is connected to the setting input S of a flip-flop memory 31. The AND elements 15 and 16 form, together with the memories 30 and 31, a switching circuit 32.

The output Q of the memory 30 is connected to a display element 33, which is grounded via a resistor 34, while a display element 35, which is grounded via a resistor 36, is connected to the output Q of the memory 31. In addition, a switch 37, which is connected to a shut-off device 38 of a drive motor 39, is connected to the outputs Q of the memories 30 and 31. The drive motor 39 drives said main shaft 17 via a toothed belt.

The elements 10 through 37 form a control device 40, which is provided for evaluating the thread voltage ($U_F$) measured by the transducer 3.

Behind the transducer 3 in the direction of thread pull (FIG. 1), a first thread guide element 42 is fastened on the sewing machine, and a second thread guide element 44 is fastened on the head 43. The needle thread is fed by the thread guide element 44 to the needle 48 via a thread lever 45 and further thread guide elements (not shown), as well as an eye 47 provided on a needle bar 46. A chain stitch looper 51 is arranged beneath the needle plate 50 accommodated in the base plate 49. The looper thread is fed to the looper 52 via a tensioning device 52 fastened on the stand 1 as well as thread guide elements (not shown).

The elements 45, 46, 48, and 51 will hereinafter be called stitch-forming elements 53.

The device operates as follows:

During sewing, the needle thread and the looper thread are pulled off from the thread reserve, while the tension of the threads varies depending on the movement of the stitch-forming elements 53. Since the needle thread and the looper thread are to be linked with one another by the stitch formation in terms of tension, one transducer 3 in the path of the needle thread is sufficient to determine the changes in the thread voltage ($U_F$) formed from the voltages of all thread.

Figure 4:
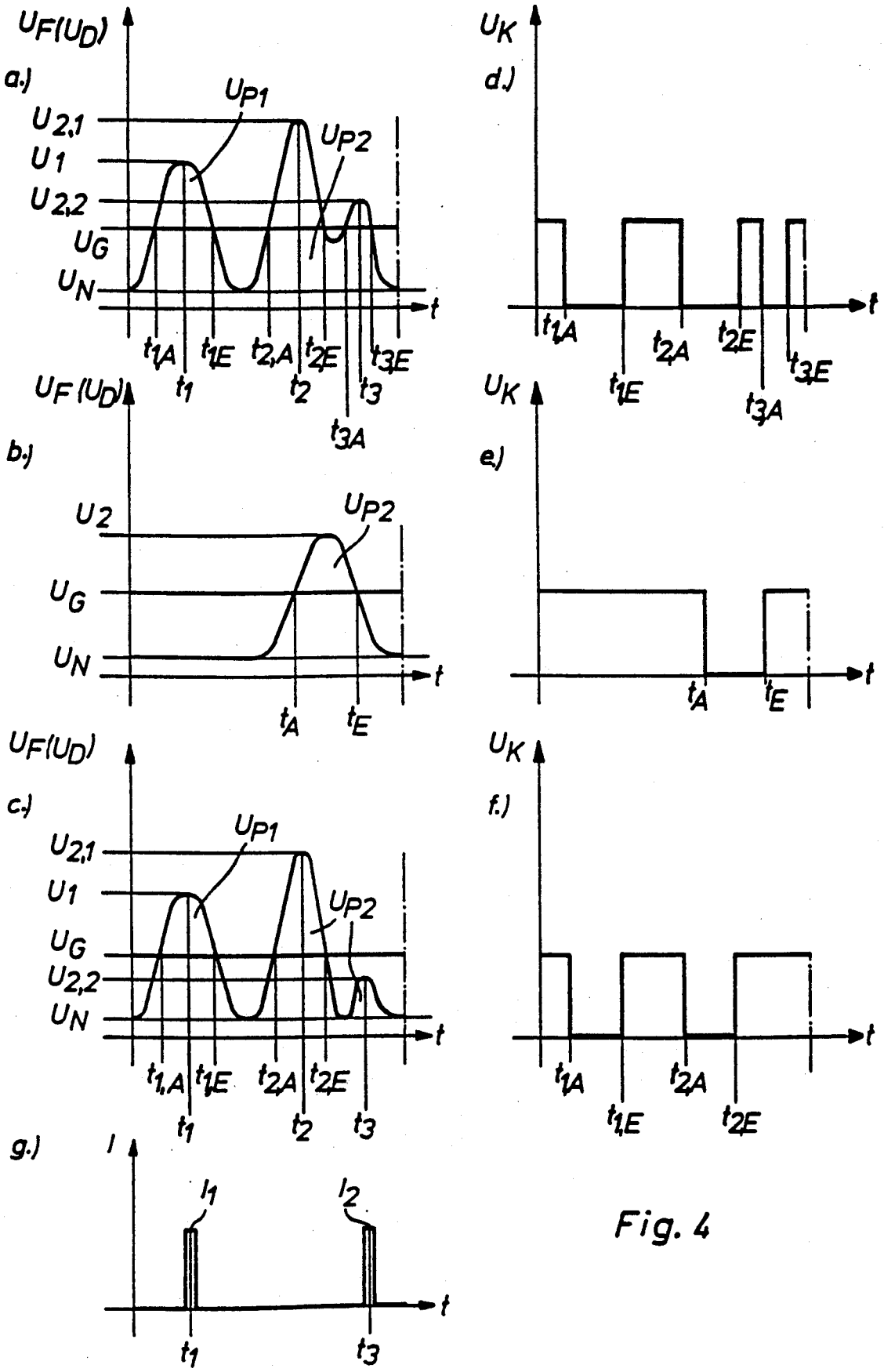
FIGS. 4*a* through 4*g* are diagrams representing the following processes relative to one stitch.

FIG. 4*a* shows the changes in the thread tension ($U_F$) during trouble-free stitch formation during one stitch.

The first tension level ($U_{p1}$) exceeding the normal tension ($U_N$) is formed when the loop of the needle thread is caught and expanded by the looper 51 after the needle 48 has passed through a material being sewn. The first tension level ($U_{p1}$) reaches its tension peak ($U_1$) at the time ($t_1$).

The second tension level ($U_{p2}$) is formed when the thread lever 45 performs an upward movement to tighten the loop formed by the needle thread and the looper thread. The tension level ($U_{p2}$) has two tension peaks ($U_{2,1}$ and $U_{2,2}$) at the times ($t_2$ and $t_3$), and the value of the first tension peak ($U_{2,1}$) exceeds that of the second tension peak ($U_{2,2}$).

When the looper 51 misses the needle thread loop, a pick-up error occurs. In the case of such an error or break of the needle thread behind the tensioning device 2 in the direction of thread pull, the thread voltage ($U_F$) changes according to FIG. 4*b*. The first tension level ($U_{p1}$) assumes the value of the normal tension ($U_N$) or even drops below this value, while the second tension level ($U_{p2}$) is formed only with one tension peak ($U_2$).

Should said needle 48 miss the loop formed by the looper thread after passing through the material being sewn, a stitch-down error occurs. Like the break of the looper thread behind said tensioning device 52 in the direction of thread pull, this is indicated by a change in the thread tension ($U_F$) according to FIG. 4*c*). Just like the first tension peak ($U_{2,1}$) of the second tension level ($U_{p2}$), the first tension level ($U_{p1}$) remains nearly unchanged, whereas the value of the second tension peak ($U_{2,2}$) is greatly reduced.

The transducer 3 (FIG. 1) is arranged between the tensioning device 2 and the thread guide element 42 so that the needle thread is deflected while passing through the eye 6. As a result, a force perpendicular to the direction of extension of the bending bar 5, by which the bending bar is deflected in the downward direction, is generated. As a consequence of this deflection, which is proportional to the thread tension ($U_F$), the WSG element 7 is tensioned on the top side of the bending bar 5, and the WSG element 8 on its underside is compressed, so that the electrical resistance of both WSG elements 7 and 8 will change. As a result, a differential tension ($U_D$) is formed, which is proportional to the deflection of said bending bar 5 and whose changes during one stitch correspond to those of the thread tension ($U_F$).

After amplification by the amplifier 10 (FIG. 3), the differential voltage ($U_D$) is sent to the voltmeter 11, which displays its value, as well as to the comparator 13. Depending on the setting of the tensioning device 2, the switching threshold of the comparator 13 can be adjusted by means of the adjusting device 14, so that its sensitivity is adjusted to the tension of the needle thread. The switching threshold is selected so that one of the tension peaks ($U_1$, $U_{2,2}$) will drop below it only when malfunction, such as a missed step or thread break, has occurred. The tension corresponding to the switching threshold will hereinafter be called the limit tension corresponding to a limit voltage ($U_G$), which is shown in FIGS. 4*a* through 4*c*.

The comparator 13 is turned on as long as the differential voltage ($U_D$) present at its input is lower than the limit voltage ($U_G$), and is turned off as soon as the differential voltage ($U_D$) assumes or exceeds the value of the limit voltage ($U_G$) FIG. 4*d* shows the changes in the output voltage ($U_K$) of said comparator (13) as a function of the differential voltage ($U_D$) according to FIG. 4*a*, while the changes in the output voltage ($U_K$) according to FIG. 4*e* are associated with those of the differential voltage ($U_D$) according to FIG. 4*b*, and the changes in the output voltage ($U_K$) according to FIG. 4*f* are associated with those of the differential voltage ($U_D$) according to FIG. 4*c*.

As long as no malfunction has occurred, the comparator output voltage ($U_K$) is present at the input of the AND elements 15 and 16 when none of the impulses ($I_1$ or $I_2$) shown in FIG. 4g, which are sent by the position transmitter 18, arrives. As a result, no signal is able to leave the AND elements 15 and 16.

In the case of the malfunction according to FIG. 4b, the impulse ($I_1$) of the position transmitter 18 arrives at time ($t_1$) from the photodetector 21 to one input of the AND element 15 when the comparator voltage output ($U_K$) is present at its other input. A signal is then sent from the output of the AND element 15 to the setting input S of the memory 30. The signal causes the memory 30 to turn on, via its output Q, the display element 33, which will display a pick-up error or the break of the needle thread. With the switch 37 closed the output Q of the memory 30 activates at the same time the shutoff device 38, which, depending on the design, turns off the drive motor 39 immediately, or prevents it from restarting after the next stoppage.

After a resetting switch (not shown) has been activated, an electrical impulse is sent in a suitable manner to the resetting input (R) of the memory 30, so that this will turn off the display element 33 and release the drive motor 39.

In the case of a malfunction according to FIG. 4c, said photodetector 25 of the position transmitter 18 sends an impulse ($I_2$) at time ($t_3$) to one input of the AND element 16, while the comparator voltage ($U_K$) is present at its other input. As a result, the AND element 16 is connected through, and sends from its output a signal to the setting input S of the memory 31, so that this will turn on, via its output Q, the display element 35, which will display a stitch-down error or a break of the looper thread. With the switch 37 closed, the output Q of the memory 31 at the same time activates, like that of the memory 30, the shutoff device 38 of the drive motor 39. The display element 35 is turned off by an electrical signal sent to the resetting input R of the memory 31, and the drive motor 39 is released.

FIG. 5 shows a second embodiment of the transducer 3. A permanent magnet 54 is fastened on the top side of the bending bar 5 at its free end. A Hall sensor 56 is fastened at the free end of a bracket 55, facing the permanent magnet 54.

During the downward deflection of the bending bar 5 under the action of the needle thread, the distance between the permanent magnet 54 and the Hall sensor 56 is increased, as a result of which the magnetic flux density and thus also the Hall voltage of the Hall sensor 56 will be reduced corresponding to the deflection of the bending bar 5. The Hall voltage is sent to and evaluated in the control device 40.

Figure 6:
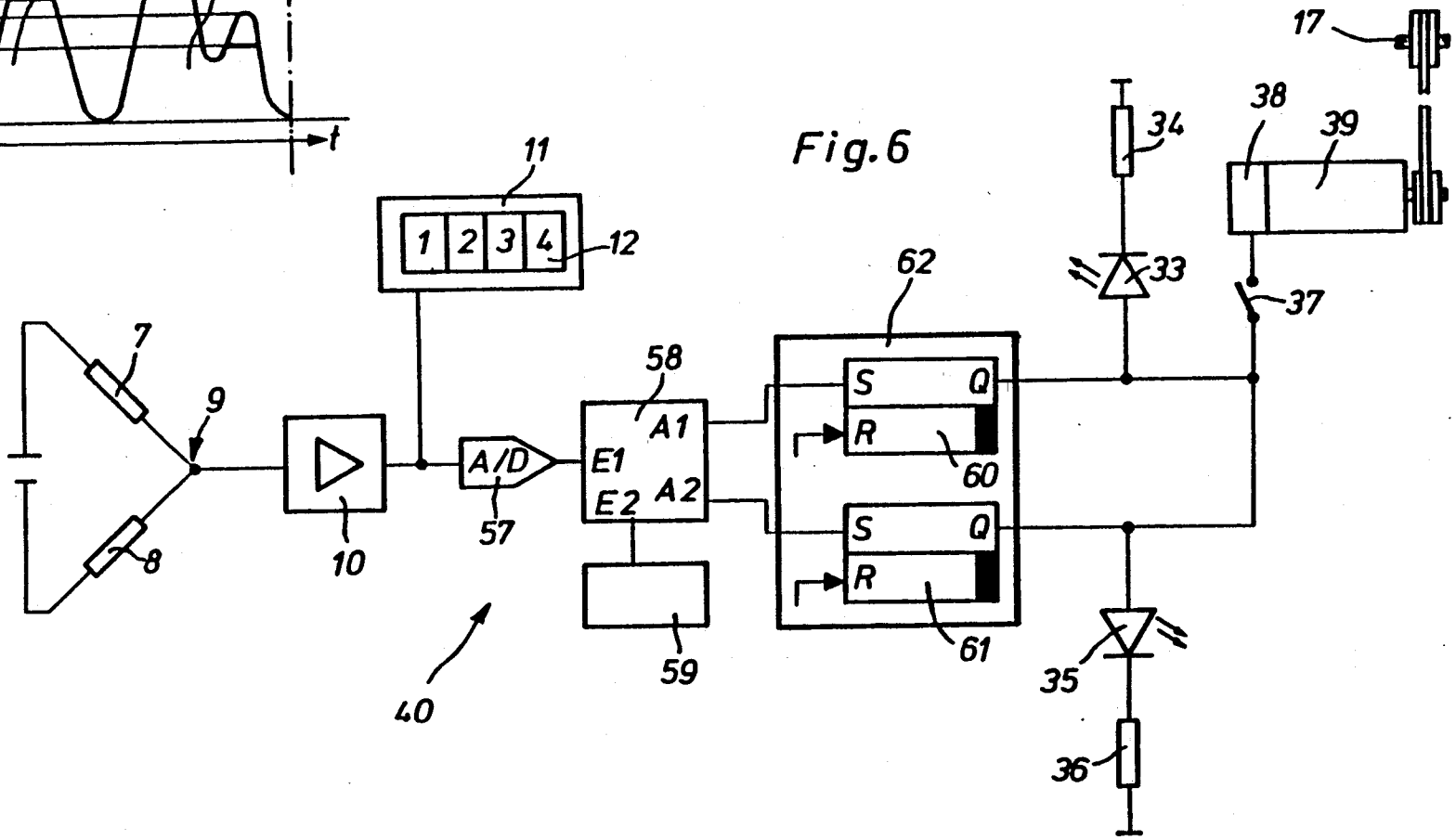
FIG. 6 is a circuit diagram showing a simplified second embodiment of the control device.

FIG. 6 shows a second embodiment of the control device 40. The output of the amplifier 10 is connected to the voltmeter 11 and, via an A/D converter 57, to one input E1 of a microprocessor 58. An input device 59 is connected to a second input E2 of the microprocessor 58.

The microprocessor 58 has outputs A1 and A2, of which the output A1 is connected to the setting input S of a flip-flop memory 60, and the output A2 is connected to the setting input S of a flip-flop memory 61. The memories 60 and 61 form a switching device 62.

The output Q of the memory 60 is connected to the display element 33, and that of the memory 61 is connected to the display element 35. Both outputs Q are also connected to the shutoff device 38 of the drive motor 39 via the switch 37.

The second embodiment of the control device 40 operates as follows:

After amplification in the amplifier 10, the differential voltage ($U_D$) (FIG. 7) is sent to the A/D converter 57. A digital voltage, which is proportional to the differential voltage ($U_D$) present on the input of the A/D converter 57, is present at the output of the A/D converter 57.

The digital voltage received at the input E1 is evaluated by the microprocessor 58 only at the time intervals in which the tension levels with proportional voltage ($U_{p1}$ and $U_{p2}$) are formed.

Figure 7:
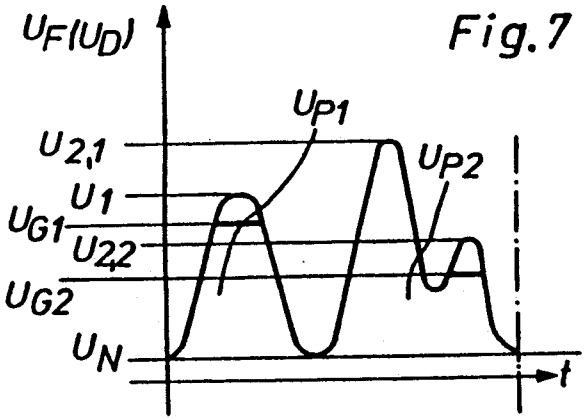
FIG. 7 is a diagram showing the thread voltage ($U_F$) without malfunction according to the second embodiment of the control device.

The microprocessor 58 determines the value from all the digital voltages associated with the first tension level ($U_{p1}$), and forms the maximum ($U_{M1}$) from these values. The maximum ($U_{M1}$) is compared with a first threshold value, which is associated with a first limit tension corresponding to a first limit voltage ($U_{G1}$) (FIG. 7). The limit voltage ($U_{G1}$) is to be preselected on the input device 59 depending on the setting of the tensioning device 2, and is sent to the microprocessor 58 via its input E2.

As long as the maximum ($U_{M1}$) corresponds to or exceeds the first threshold value, no signal is sent by the microprocessor 58. However, when the maximum ($U_{M1}$) drops below the first threshold value as a consequence of a pick-up error or a disturbance on the needle thread, the microprocessor 58 sends an impulse from the output A1 to the memory 60, as a result of which the memory 60 is switched over, and activates said display element 33 via its output Q and, with the switch 37 closed, it activates the shutoff device 38 of the drive motor 39.

The maximum ($U_{M2}$) is formed from the values of the digital voltages associated with the second tension peak corresponding to voltage peak ($U_{2,2}$) of the tension level corresponding to voltage level ($U_{p2}$) and compared with a second threshold value, which is associated with a second limit tension corresponding to a limit voltage ($U_{G2}$) (FIG. 7). Like the limit voltage ($U_{G1}$), this is to be preselected on the input device 59 depending on the setting of the tensioning device 2.

When the maximum ($U_{M2}$) corresponds to or exceeds the second threshold value, no signal is sent by the microprocessor 58. However, when the maximum ($U_{M2}$) drops below the second threshold value as a consequence of a stitch-down error or a disturbance on the looper thread, the microprocessor 58 sends from its output A2 an impulse to the memory 61. As a result, this is switched over, and controls, via its output Q, the display element 35 and the shutoff device 38 of the drive motor 39.

The memories 60 and 61 can be switched over to their starting position by an electrical signal to the resetting input (R).

By presetting different limit voltages ($U_{G1}$, $U_{G2}$) for the different maxima ($U_{M1}$ and $U_{M2}$), the respective threshold value can be optimally adjusted to the corresponding maximum.

While specific embodiments of the invention have been shown and described in detail to illustrate the application of the principles of the invention, it will be understood that the invention may be embodied otherwise without departing from such principles.

What is claimed is:

1. A stitch-forming machine, comprising:

a transducer for determining tension present in a thread, the tension assuming a higher value during stitch formation, the transducer generating a tension signal representing a thread tension level; and control means for evaluating the thread tension level, said control means including a comparator for comparing peaks in said tension signal, wherein a peak can be used to detect a malfunction, with a limit signal representing a tension limit, and for generating a switching signal when a tension signal peak drops below the limit signal and including a switching device connected to a shutoff device of a drive motor of the stitch forming machine and to a display element, said switching signal stopping the machine and activating the display element.

2. A stitch-forming machine, comprising:

a transducer for determining the tension in a thread and generating a signal representing the thread tension; and control means for evaluating the thread tension with respect to a phase of stitch formation, the control means including a comparator device for comparing voltage peaks occurring during said phase, corresponding to thread tension peaks, of each tension signal with a predeterminable common limit signal, corresponding to a common limit tension and for generating a comparator output switching signal when a tension signal peak drops below the limit signal and including a switching device connected to a shutoff device of a drive motor of the machine and connected to a display element, said control means allowing said comparator output switching signal to energize said switching device depending upon a stitch formation phase, for stopping the machine and activating the display element.

3. A stitch-forming machine according to either claim 1 or claim 2, wherein said stitch forming machine forms a chain stitch seam having a thread tension with a first tension level during an expansion of a needle thread loop and having a second tension level during a knotting of the needle thread loop, said switching device being energized by said comparator switching signal when said tension signal drops below said limit signal for switching and a pick-up error display element for detecting a pick-up error or a disturbance of the needle thread and when the tension signal of the second tension level, which has two tension peaks, drops below an additional limit signal, a second display element is activated for detecting a stitch-down error, or, in the case of a multi-thread chain stitch machine, a disturbance of a looper thread.

4. A stitch-forming machine according to either claim 1 or claim 2, wherein said comparator device includes an adjusting device for providing a predetermined limit signal as a function of a setting of a tensioning device associated with the thread being monitored.

5. A stitch-forming machine according to either claim 1 or claim 2, wherein said transducer comprises a spring member connected to the tensioned thread, said spring member being deflected by said tensioned thread and a sensor device generating said tension signal in proportion to a deflection of said spring member, said spring member being formed as a bending bar which tapers toward a free end beginning from a clamping end.

6. A stitch-forming machine according to either claim 1 or claim 2, wherein said transducer is fastened on the machine via a damping element.

7. A stitch-forming machine according to either claim 1 or claim 2, wherein said transducer is arranged immediately downstream of said tensioning device.

8. A stitch-forming machine, comprising:

a transducer for determining the tension in a thread and generating a signal representing the thread tension; and control means for evaluating the thread tension with respect to a phase of stitch formation, the control means including a comparator device for comparing voltage peaks, corresponding to thread tension peaks, of each tension signal with a predeterminable common limit signal, corresponding to a common limit tension and for generating a comparator output signal when a tension signal peak drops below the limit signal and including a switching device connected to a shutoff device of a drive motor of the machine and connected to a display element, said control means allowing said comparator output signal to energize said switching device depending upon a stitch formation phase, for stopping the machine and activating the display element, wherein said stitch forming machine forms a chain stitch seam having a thread tension with a first tension level during an expansion of a needle thread loop and having a second tension level during a knotting of the needle thread loop, said switching device being energized by said comparator signal when said tension signal drops below said limit signal for switching and a pick-up error display element for detecting a pick-up error or a disturbance of the needle thread and when the tension signal of the second tension level, which has two tension peaks, drops below an additional limit signal, a second display element is activated for detecting a stitch-down error, or, in the case of a multi-thread chain stitch machine, a disturbance of a looper thread.

9. A stitch forming machine comprising:

a transducer for determining tension present in a thread, the tension assuming a higher value during stitch formation, the transducer generating a tension signal representing a thread tension level;

needle position means for generating a signal representing one or more predetermined positions of the needle during stitch formation, said one or more predetermined positions normally corresponding to said higher value of the tension resulting in peaks in said tension signal; and control means for evaluating the thread tension level, said control means including a comparator for comparing said thread tension level with a thread tension peak limit signal representing a thread tension peak limit, upon receiving said thread needle position signal, said thread tension peak limit having a value higher than a normal thread tension, occurring during a period of no stitch formation, and for generating a switching signal when said thread tension level signal, during said needle position signal, drops below said tension peak limit signal.

10. A stitch-forming machine according to claim 9, wherein said stitch forming machine forms a chain stitch seam having a thread tension with a first tension level during an expansion of a needle thread loop and having a second tension level during a knotting of the needle thread loop, said switching device being energized by said switching signal when said tension signal drops below said limit signal for switching and a pick-up error display element for detecting a pick-up error or a disturbance of the needle thread and when the tension signal of the second tension level, which has two tension peaks, drops below an additional limit signal, a second display element is activated for detecting a stitch-down error, or, in the case of a multi-thread chain stitch machine, a disturbance of a looper thread.

11. A stitch-forming machine according to claim 9, wherein said comparator device includes an adjusting device for providing a predetermined limit signal as a function of a setting of a tensioning device associated with the thread being monitored.

12. A stitch-forming machine according to claim 9, wherein said transducer comprises a spring member connected to the tensioned thread, said spring member being deflected by said tensioned thread and a sensor device generating said tension signal in proportion to a deflection of said spring member, said spring member being formed as a bending bar which tapers toward a free end beginning from a clamping end.

13. A stitch-forming machine according to claim 9, wherein said transducer is fastened on the machine via a damping element.

14. A stitch-forming machine according to claim 9, wherein said transducer is arranged immediately downstream of said tensioning device.

* * * * *